US006625415B2

(12) United States Patent
Nakashima et al.

(10) Patent No.: US 6,625,415 B2
(45) Date of Patent: Sep. 23, 2003

(54) LIQUID-DEVELOPMENT FULL-COLOR ELECTROPHOTOGRAPHIC DEVICE

(75) Inventors: Yutaka Nakashima, Kanazawa (JP); Akihiko Inamoto, Uchinada-machi (JP); Shigeki Uesugi, Unoke-machi (JP); Satoru Moto, Kanazawa (JP); Motoharu Ichida, Tsubata-machi (JP); Masanari Takabatake, Kanazawa (JP); Shigeharu Okano, Hakui (JP); Seiichi Takeda, Kanazawa (JP); Tadashi Nishikawa, Tsubata-machi (JP); Satoshi Miyamoto, Hakui (JP); Hitoshi Terashima, Kanazawa (JP); Satoshi Sakai, Kanazawa (JP); Hironaga Hongawa, Uchinada-machi (JP); Masanobu Hongo, Unoke-machi (JP); Jiyun Du, Kanazawa (JP)

(73) Assignee: Pfu Limited, Ishikawa (JP)

( * ) Notice: Subject to any disclaimer, the term of this patent is extended or adjusted under 35 U.S.C. 154(b) by 0 days.

(21) Appl. No.: 10/031,335

(22) PCT Filed: Jun. 1, 2001

(86) PCT No.: PCT/JP01/04648

§ 371 (c)(1),
(2), (4) Date: Jan. 18, 2002

(87) PCT Pub. No.: WO01/98841

PCT Pub. Date: Dec. 27, 2001

(65) Prior Publication Data

US 2002/0106220 A1 Aug. 8, 2002

(30) Foreign Application Priority Data

Jul. 31, 2000 (JP) ..... 2000-230161
Jun. 21, 2000 (JP) ..... 2000-185620

(51) Int. Cl.[7] ..... G03G 15/20

(52) U.S. Cl. ..... 399/237; 399/302; 399/233; 399/299

(58) Field of Search ..... 399/233, 237, 399/297, 299, 298, 302

(56) References Cited

U.S. PATENT DOCUMENTS 5,953,566 A 9/1999 Fujiwara et al.
6,173,147 B1 * 1/2001 Nakashima et al. ..... 399/308

FOREIGN PATENT DOCUMENTS

| | | |
|---|---|---|
| EP | 0 997 792 | 5/2000 |
| JP | 64-059276 | 3/1989 |
| JP | 5-232823 | 9/1993 |
| JP | 2000-056575 | 2/2000 |

* cited by examiner

*Primary Examiner*—Hoang Ngo

(57) ABSTRACT

A liquid-development full-color electrophotographic apparatus utilizes a development section having a liquid toner as a liquid developer to form a toner image according to an electric field established between the development section and a photosensitive drum. The toner image is transferred from the photosensitive drum onto an intermediate transfer roller according to an electric field established between the intermediate transfer roller and the photosensitive drum, from the intermediate transfer roller to an intermediate transfer belt, and then to a transfer-and-fixation section, which melt-transfers the toner image onto a printing medium. A voltage controlled according to electric characteristics of each color toner is applied to the corresponding photosensitive drums while the roller is grounded. A toner cohesion enhancement unit is provided for enhancing the degree of toner cohesion of a toner image transferred and reverse transfer is suppressed.

10 Claims, 5 Drawing Sheets

LIQUID-DEVELOPMENT FULL-COLOR ELECTROPHOTOGRAPHIC DEVICE

TECHNICAL FIELD

The present invention relates to a liquid-development full-color electrophotographic apparatus, and more particularly, to a liquid-development full-color electrophotographic apparatus which optimally controls transfer of toner images in a plurality of colors from a photosensitive drum(s) to an intermediate transfer roller.

BACKGROUND ART

As an electrophotographic apparatus operating by the steps of generating an electrostatic latent image on a photosensitive body (a photosensitive drum), causing toner to be attracted to the electrostatic latent image, transferring the toner onto paper or the like, and fixing the transferred toner, a dry-type apparatus, which uses a powder toner, is widely used.

However, a powder toner involves the following problems: toner particles scatter; and since toner particles have a relatively large particle size of 7 $\mu$m to 10 $\mu$m, resolution is low.

Thus, when high resolution is required, a liquid-development-type apparatus, which uses a liquid toner, is used for the following reason. A liquid toner has a small toner particle size of about 1 $\mu$m and exhibits a large electrostatic-charge capacity. Thus, a toner image is unlikely to be disturbed, and high resolution can be achieved.

FIG. 8 shows the overall configuration of a conventional liquid-development-type electrophotographic apparatus (disclosed in, for example, Japanese Patent Application Laid-Open (kokai) No. 2000-056575). In FIG. 8, a photosensitive drum 10 is electrostatically charged by means of a charger 21. Subsequently, the photosensitive drum 10 is exposed to light by means of an exposure unit 22, whereby an electrostatic latent image is formed. A prewetting unit 23 applies, for example, silicone oil to the surface of the photosensitive drum 10.

Developing units 24 corresponding to yellow, magenta, cyan, and black are provided and use as a liquid developer a nonvolatile, high-viscosity, high-concentration liquid toner. A developing roller supplies the liquid developer onto the photosensitive drum 10 while causing toner particles contained in the liquid developer to adhere to the photosensitive drum 10 according to an electric field established between the same and the photosensitive drum 10.

An intermediate transfer roller 15 transfers color toners one by one from the photosensitive drum 10 according to an electric field established between the same and the photosensitive drum 10. When the intermediate transfer roller 15 transfers toner particles from the photosensitive drum 10 according to an electric field established between the same and the photosensitive drum 10, oil which is composed of excessive prewetting liquid and carrier in a developed toner layer and which, together with toner particles, is transferred from the photosensitive drum 10 to the intermediate transfer roller 15. In order to remove the oil, the intermediate transfer roller 15 is equipped with an oil-removing roller 25.

A heating unit 28 heats the surface of the intermediate transfer roller 15 to thereby melt toner adhering to the intermediate transfer roller 15. Heating by the heating unit 28 is performed after all color toners have been transferred onto the intermediate transfer roller 15. A pressure roller 19 is adapted to fix on a printing medium the toners which are melted on the intermediate transfer roller 15 by means of the heating unit 28. Reference numeral 26 denotes a blade for scraping off residual development toner, and reference numeral 27 denotes a destaticizer.

In such a single-photosensitive-drum-type electrophotographic apparatus, which uses a single photosensitive drum 10, in order to transfer toner images in four colors from the photosensitive drum 10, the intermediate transfer roller 15 must be rotated four rotations. This configuration is disadvantageous in terms of printing speed.

High-speed printing can be implemented through employment of four photosensitive drums corresponding to four colors. Toner images formed on the corresponding photosensitive drums are sequentially superposed on an intermediate transfer roller. This configuration reduces the size of the apparatus. However, in a multiple-photosensitive-drum-type full-color electrophotographic apparatus, when a toner image on the surface of a photosensitive drum is to be transferred onto the intermediate transfer roller, as shown in FIG. 6, a bias voltage must be applied to an intermediate transfer roller 15.

In FIG. 6, while photosensitive drums 11–14 corresponding to four colors are grounded, a constant bias potential of, for example, −500 V is applied to the intermediate transfer roller 15. The bias potential causes toner images on the corresponding photosensitive drums 11–14 to be transferred onto the intermediate transfer roller 15.

However, since the color toners differ in electric characteristics depending on pigment to be used, application of a common electric potential among the colors as illustrated fails to yield an optimum transfer efficiency.

A carrier solvent to be used in liquid development is intended to prevent scattering of toner particles, which assume a particle size of about 1 $\mu$m, as well as to uniformly disperse toner particles through electrification of the toner particles. In development and electrostatic transfer processes, the carrier solvent serves as a "bridge" to facilitate movement of toner particles, which is effected by means of electric-field action.

When color toners are transferred one by one from a photosensitive drum to an intermediate transfer roller, all toner particles are transferred according to an electric field established between the photosensitive drum and the intermediate drum. However, in actuality, some toner particles which have previously been transferred onto the intermediate transfer body may be reversely transferred onto the photosensitive drum.

FIG. 7 is a view for explaining reverse transfer from the intermediate transfer body to the photosensitive drum. The illustration shows a state in which a second color toner is transferred onto the intermediate transfer body onto which a first color toner has already been transferred, to thereby super pose the second color toner on the first color toner. Essentially, all toner particles are expected to be transferred and superposed on the intermediate transfer body as a result of being subjected to an electric-field action. However, in some cases, some of the toner particles of the first color are reversely transferred onto the photosensitive drum. This is considered undesirable.

DISCLOSURE OF THE INVENTION

An object of the present invention is to provide a liquid-development full-color electrophotographic apparatus wherein, in order to optimally control transfer of toner images in a plurality of colors from a photosensitive drum(s)

to an intermediate transfer roller, an optimal transfer bias is applied for each of the colors according to electrical characteristics of the corresponding color toner so as to yield optimal transfer efficiency for the color toner.

Another object of the present invention is to provide a liquid-development full-color electrophotographic apparatus wherein, in order to optimally control transfer of toner images in a plurality of colors from a photosensitive drum(s) to an intermediate transfer roller, reverse transfer of a toner image from the intermediate transfer roller to a photosensitive body is prevented in the course of superposing transfer, to thereby prevent image deterioration.

A liquid-development full-color electrophotographic apparatus of the present invention comprises a development section using a liquid toner as a liquid developer, the development section being in contact with a photosensitive drum, on which an electrostatic latent image is formed, so as to supply the liquid developer onto the photosensitive drum, and causing toner particles contained in the liquid developer to adhere to the photosensitive drum according to an electric field established between the development section and the photosensitive drum to thereby form a toner image; an intermediate transfer roller to which the toner image is transferred from the photosensitive drum according to an electric field established between the same and the photosensitive drum; and a transfer-and-fixation section for further transferring the toner image from the intermediate transfer roller onto an intermediate transfer belt and then melting the toner image through application of heat at a contact portion between the intermediate transfer belt and a printing medium to thereby melt-transfer the toner image onto the printing medium. A plurality of photosensitive drums are provided in such a manner as to correspond to liquid toners in a plurality of colors. Toner images formed on the photosensitive drums corresponding to the respective colors are sequentially transferred and superposed on the intermediate transfer roller. An electric field for transferring a toner image from each of the photosensitive drums to the intermediate transfer roller is established through application, to the corresponding photosensitive drums, of a voltage controlled according to electric characteristics peculiar to a color toner on the photosensitive drums while the intermediate transfer roller is grounded.

A liquid-development full-color electrophotographic apparatus of the present invention comprises a development section using liquid toners in a plurality of colors as liquid developers, the development section being in contact with an image bearer body, on which an electrostatic latent image is formed, so as to supply the liquid developer onto the image bearer body, and causing toner particles contained in the liquid developer to adhere to the image bearer body according to an electric field established between the development section and the image bearer body to thereby form a toner image in a corresponding color; and an intermediate transfer body to which the toner image for each of the plurality of colors is transferred from the image bearer body, the transferred toner images being superposed on one another. The liquid-development full-color electrophotographic apparatus further comprises means for enhancing the degree of toner cohesion of a toner image transferred onto the intermediate transfer body in order to suppress reverse transfer of a previously transferred toner image to the image bearer body; and a transfer-and-fixation section for melting a toner image formed, through transfer and superposition, on the intermediate transfer body through application of heat at a contact portion between the intermediate transfer body and a printing medium to thereby melt-transfer the toner image onto the printing medium.

BEST MODE FOR CARRYING OUT THE INVENTION

Figure 1:
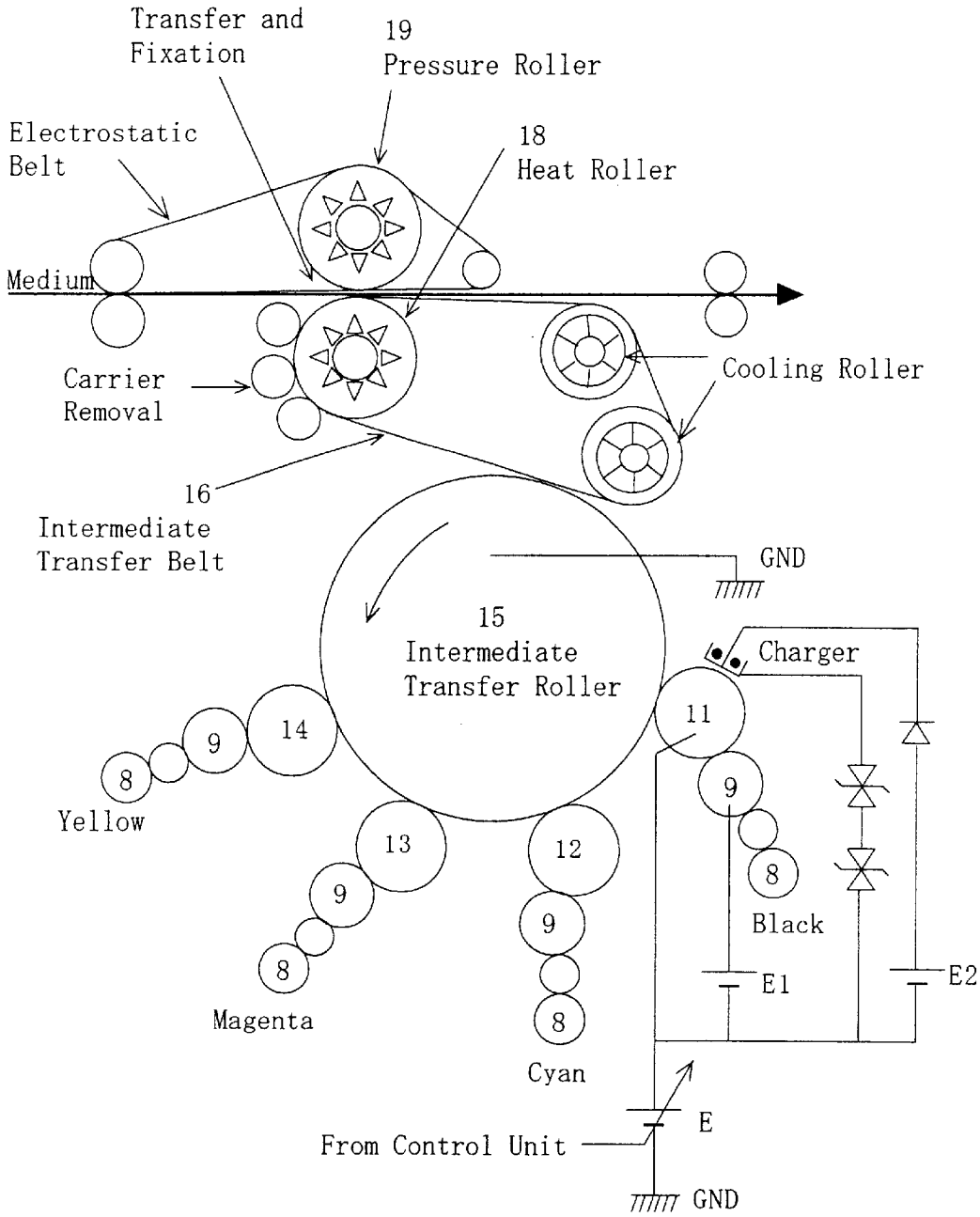
FIG. 1 is a view showing the configuration of a liquid-development-type full-color electrophotographic apparatus that embodies the present invention.

Embodiments of the present invention will next be described in detail. FIG. 1 is a view showing a configuration example of a liquid-development-type electrophotographic apparatus that embodies the present invention. The illustrated apparatus includes a development section provided at a bottom portion of the apparatus, an intermediate transfer section disposed above the development section, and a transfer-and-fixation section located at a top portion of the apparatus. In the illustrated apparatus, the transfer-and-fixation section, which generates a large amount of heat, is disposed at a top portion of the apparatus. Thus, heat can be efficiently released from inside the apparatus. Also, the development section, which handles a liquid toner, is disposed at a bottom portion of the apparatus. Thus, even when the liquid toner spills, a printing medium is hardly smudged.

Photosensitive drums 11–14 are provided while corresponding to yellow, magenta, cyan, and black. Developing rollers 9 corresponding to the colors are biased at a predetermined voltage of about 400 V-600 V and function to supply positively charged toner to the corresponding photosensitive drums 11–14 according to electric fields established between the same and the photosensitive drums 11–14. In order to clarify illustration, application of a bias potential is illustrated merely with respect to the photosensitive drum 11 and the developing roller 9 in contact with the photosensitive drum 11 while application of a bias potential is unillustrated with respect to the photosensitive drums of other colors and the corresponding developing rollers.

An intermediate transfer roller 15 is grounded. A bias potential for establishing an electric field for transfer between the intermediate transfer roller 15 and the photosensitive drums 11–14 is applied to the photosensitive drums 11–14 independently of one another. The photosensitive drums 11–14 are biased at, for example, about +800, whereby toner is transferred from the photosensitive drums 11–14 to the intermediate transfer roller 15 according to electric fields established between the intermediate transfer roller 15 and the photosensitive drums 11–14.

For the photosensitive drums 11–14, a control unit outputs control signals corresponding to respective colors. Each of the control signals is set to apply, to the corresponding photosensitive drum, an optimal transfer bias potential E according to electric characteristics of the corresponding color toner. The control signal can be set according to electric characteristics of each color toner by use of the control unit, which is composed of, for example, a microcomputer. A development bias potential E1, which is positive with respect to each of the photosensitive drums 11–14, is applied to each of the developing rollers 9. An electric potential (a charging potential) E2, which is positive with respect to each of the photosensitive drums 11–14, is applied to a charger (only a single charger is illustrated while other chargers are unillustrated) for electrostatically charging the corresponding photosensitive drum. As illustrated, since the development bias potential E1 and the charging potential E2 are applied with respect to a photosensitive drum, even when the transfer bias potential E is varied through control, the development bias potential E1 and the charging potential E2 can be applied according to the varied transfer bias potential E.

The bias potential E1 applied to the developing rollers causes exposed portions on the photosensitive drums 11–14 to be charged at about 100 V. Toner adheres to the exposed portions on the photosensitive drums 11–14, thereby developing electrostatic latent images on the photosensitive drums 11–14 into respective images. A single or a plurality of toner supply rollers 8 are provided for each color toner. The toner supply rollers 8 convey a liquid toner from a toner fountain to a developing roller 9 while spreading the liquid toner thinner, to thereby apply the liquid toner onto the developing roller 9 at a predetermined layer thickness (e.g., 4–10 $\mu$m). Notably, the liquid toner has a toner viscosity of 100–4000 mPa·S and a carrier viscosity of 20–500 cSt, preferably 100 cSt.

According to the present invention, in transfer from photosensitive drums to an intermediate transfer roller, an optimal transfer bias is applied for each of colors according to electrical characteristics of the corresponding color toner, to thereby yield optimal transfer efficiency for the color toner.

Transfer of toner onto the intermediate transfer roller 15 is sequentially performed, for example, in the following manner: first, transfer of a yellow toner adhering to the photosensitive drum 14; next, transfer of a magenta toner adhering to the photosensitive drum 13; then, transfer of a cyan toner adhering to the photosensitive drum 12; and finally, transfer of a black toner adhering to the photosensitive drum 11. While the intermediate transfer roller 15 is rotated a single rotation, toner images in four colors developed on the photosensitive drums 11–14 are sequentially superposed on the intermediate transfer roller 15 to thereby form a color image.

Alternatively, control can be performed so as to rotate the intermediate transfer roller 15 four rotations. In this case, transfer of toner onto the intermediate transfer roller 15 is sequentially performed in the following manner: first, transfer of, for example, a black toner adhering to the photosensitive drum 11; next, transfer of, for example, a cyan toner adhering to the photosensitive drum 12; then, transfer of, for example, a magenta toner adhering to the photosensitive drum 13; and finally, transfer of, for example, a yellow toner adhering to the photosensitive drum 14. Thus, while the intermediate transfer roller 15 is rotated four rotations, toner images in four colors developed on the photosensitive drums 11–14 are sequentially superposed on the intermediate transfer roller 15 to thereby form a color image.

The 4-color image formed through superposition in the course of a single rotation or four rotations of the intermediate transfer roller 15 is electrostatically transferred onto an intermediate transfer belt 16, which serves as a second intermediate transfer body in the form of a belt. After carrier liquid is removed at a carrier-removing section, the transferred toner image is melted through application of heat at a contact portion between the intermediate transfer belt 16 and a printing medium to thereby be melt-transferred onto the printing medium. An image which is formed on the intermediate transfer belt 16 by means of a liquid toner contains carrier liquid. The carrier oil component is removed from the toner image at the carrier-removing section.

The toner image on the intermediate transfer belt 16 is melted through application of heat by means of a heat roller 18. The resulting molten toner image is transferred onto and fixed on the printing medium by means of a heater-incorporated pressure roller 19, which operates in cooperation with the heat roller 18.

The transfer-and-fixation section includes the pressure roller 19, a plurality of conveyance rollers, an electrostatic belt looped around and mounted on the pressure roller 19 and the conveyance rollers, and the intermediate transfer belt 16. The electrostatic belt electrostatically chucks a printing medium to thereby convey the printing medium. Heating by means of the heat roller 18 is intended to improve the efficiency of carrier removal as well as to melt a toner image on the intermediate transfer belt 16 in cooperation with the heater-incorporated pressure roller 19 to thereby transfer the resulting molten toner image onto and fix on the printing medium. After transfer and fixation, the thus heated intermediate transfer belt 16 must be cooled. The intermediate transfer belt 16 can be cooled, for example, through cooling rollers (cooling rollers) which the intermediate transfer belt 16 is looped around and mounted on. The intermediate transfer belt 16 is cooled in order to prevent a problem in that when toner is transferred from the intermediate transfer roller 15 to the intermediate transfer belt 16, the toner would otherwise melt with a resultant occurrence of transfer error, as well as to prevent transmission of heat to the intermediate transfer roller 15.

Figure 2:
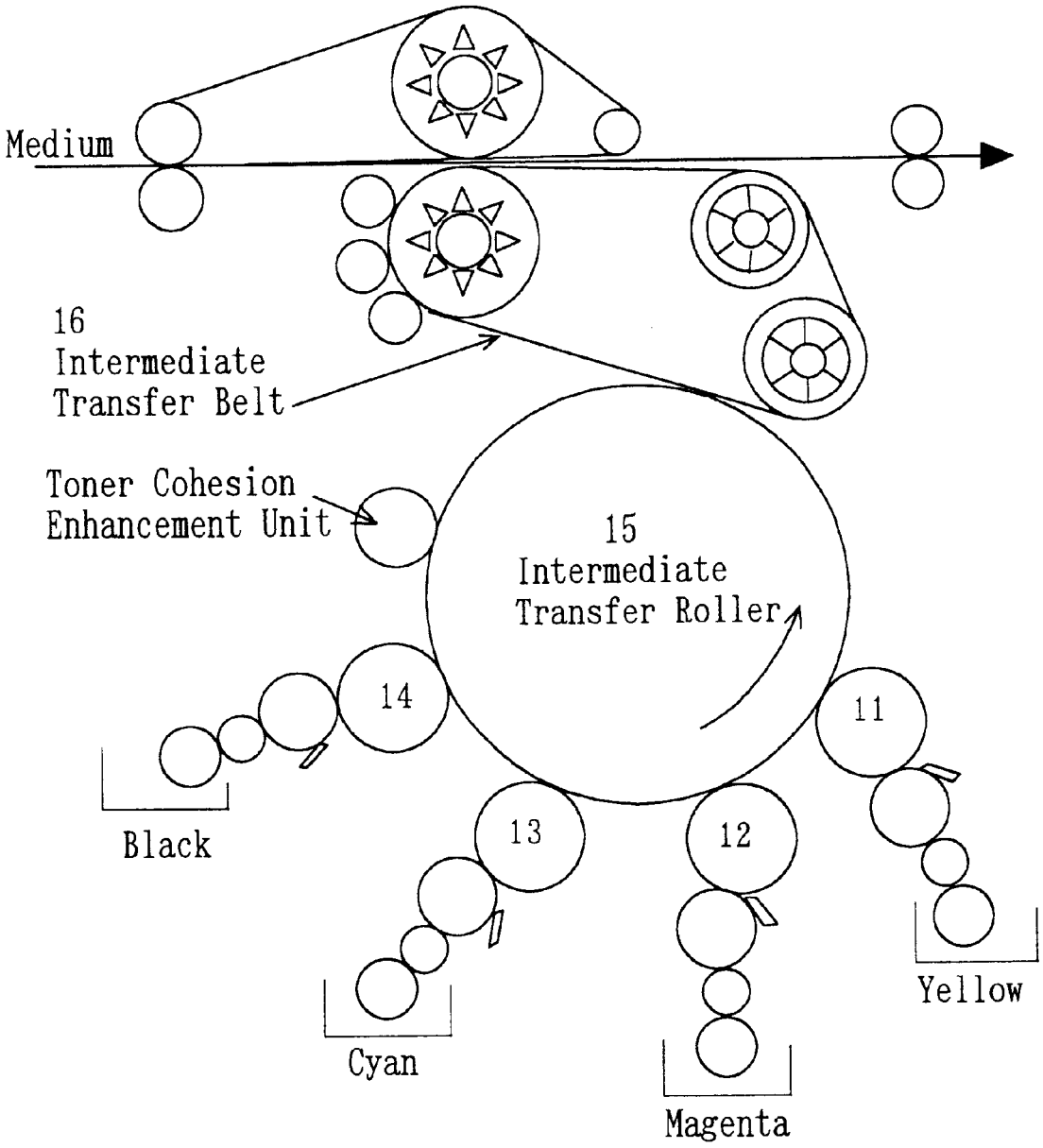
FIG. 2 is a view showing the disposition of a toner cohesion enhancement unit in the liquid-development-type full-color electrophotographic apparatus that embodies the present invention.

Next, a toner cohesion enhancement unit will be described with reference to FIG. 2. The intermediate transfer roller 15 is equipped with the toner cohesion enhancement unit, which is located upstream of photosensitive drums. The toner cohesion enhancement unit is operative to enhance the degree of toner cohesion of a toner image transferred onto the intermediate transfer roller 15 in order to suppress reverse transfer of a previously transferred toner image to a photosensitive drum. Reverse transfer of a toner image to a photosensitive drum occurs when adhesion between toner particles and the photosensitive drum is greater than a force to be imposed on toner particles at a transfer point by means of an electric field, and adhesion among toner particles. Enhancement of the degree of cohesion of toner particles increases adhesion among toner particles, to thereby reduce reverse transfer to a photosensitive drum.

As mentioned previously, control can be performed such that, while the intermediate transfer roller 15 is rotated four rotations, four color toner images are sequentially superposed on the intermediate transfer roller 15. In this case, as shown in FIG. 2, disposition of a single toner cohesion unit on the intermediate transfer roller will suffice. As mentioned previously, while the intermediate transfer roller 15 is rotated a single rotation, four color toner images can be sequentially superposed on the intermediate transfer roller 15. In this case, a total of three toner cohesion enhancement units are provided on the intermediate transfer roller 15 while being individually located between the photosensitive drums 11–14.

The toner cohesion enhancement unit can be applied to a liquid-development full-color electrophotographic apparatus using a single photosensitive drum so long as the apparatus is configured such that toner images in a plurality of colors are sequentially superposed on an intermediate transfer roller.

Figure 3:
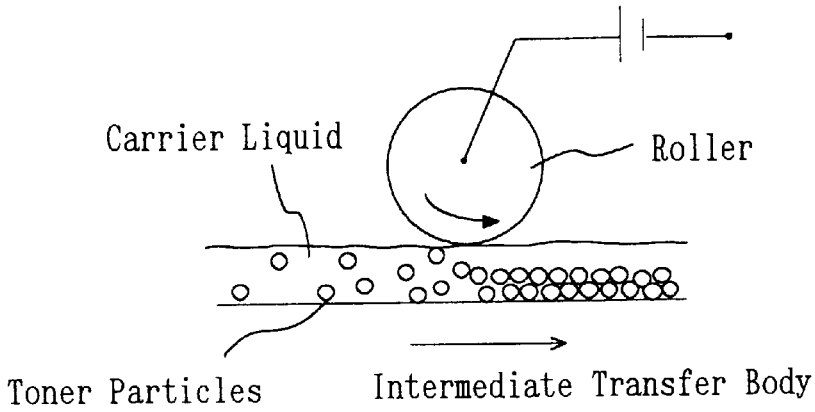
FIG. 3 is a view for explaining a first embodiment of the toner cohesion enhancement unit.

FIG. 3 is a view for explaining a first embodiment of the toner cohesion enhancement unit. As illustrated, an intermediate transfer body on which all color toner images are superposed is equipped with a roller to which a bias voltage is applied, the roller serving as a toner cohesion enhancement unit. Since a bias voltage is applied to the roller, a force induced by an electric field associated with the bias voltage is imposed on toner particles and causes the toner particles to electrically move and cohere toward the surface of the intermediate transfer body.

Figure 4:
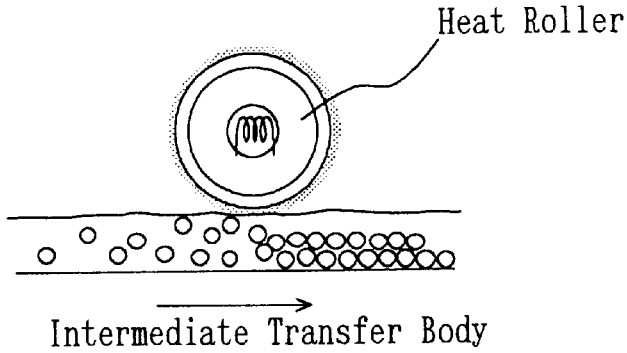
FIG. 4 is a view for explaining a second embodiment of the toner cohesion enhancement unit, a heat roller serving as the toner cohesion enhancement unit.

FIG. 4 is a view for explaining a second embodiment of the toner cohesion enhancement unit, a heat roller serving as the toner cohesion enhancement unit. Toner on an intermediate transfer body is melted through application of heat, and the resulting molten toner is cooled forcibly or naturally to thereby integrate toner particles on the intermediate transfer body, whereby the degree of toner cohesion is enhanced.

Figure 5:
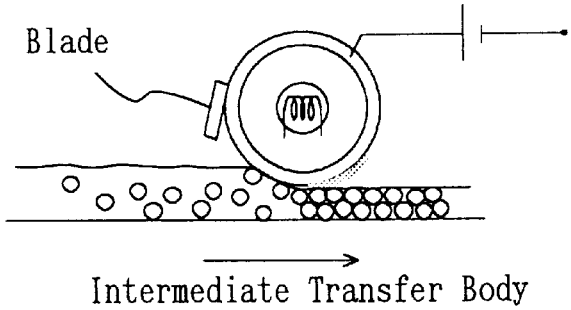
FIG. 5 is a view showing a third embodiment of the toner cohesion enhancement unit, in which a heat roller is electrically conductive, and a bias voltage is applied to the heat roller.
Figure 6:
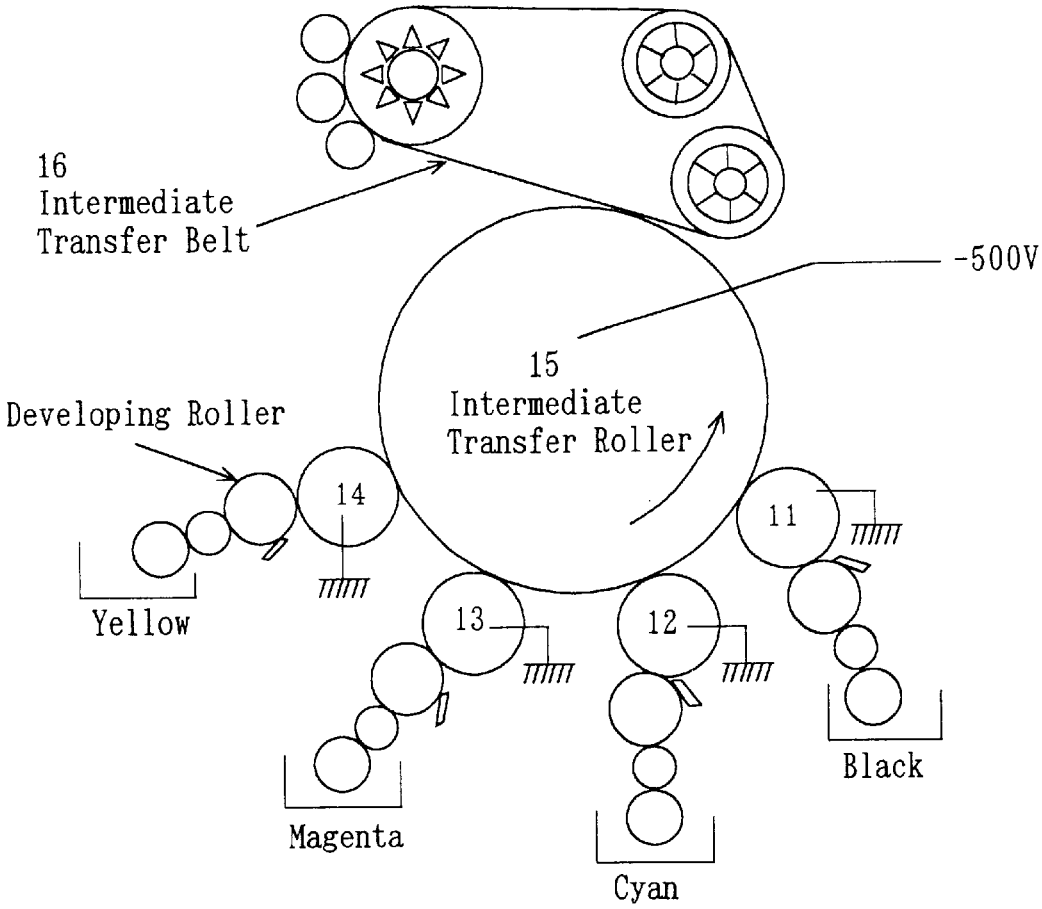
FIG. 6 is a view for explaining a problem involved in a multiple-photosensitive-drum-type full-color electrophotographic apparatus in which a bias voltage is applied to an intermediate transfer roller.
Figure 7:
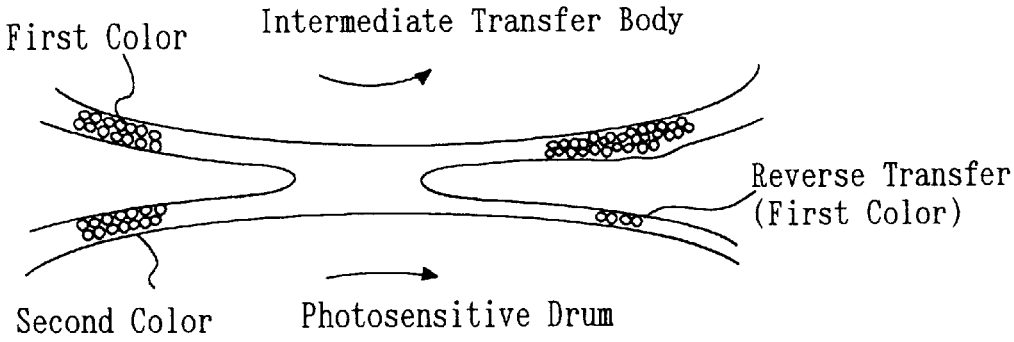
FIG. 7 is a view for explaining reverse transfer from an intermediate transfer body to a photosensitive drum.
Figure 8:
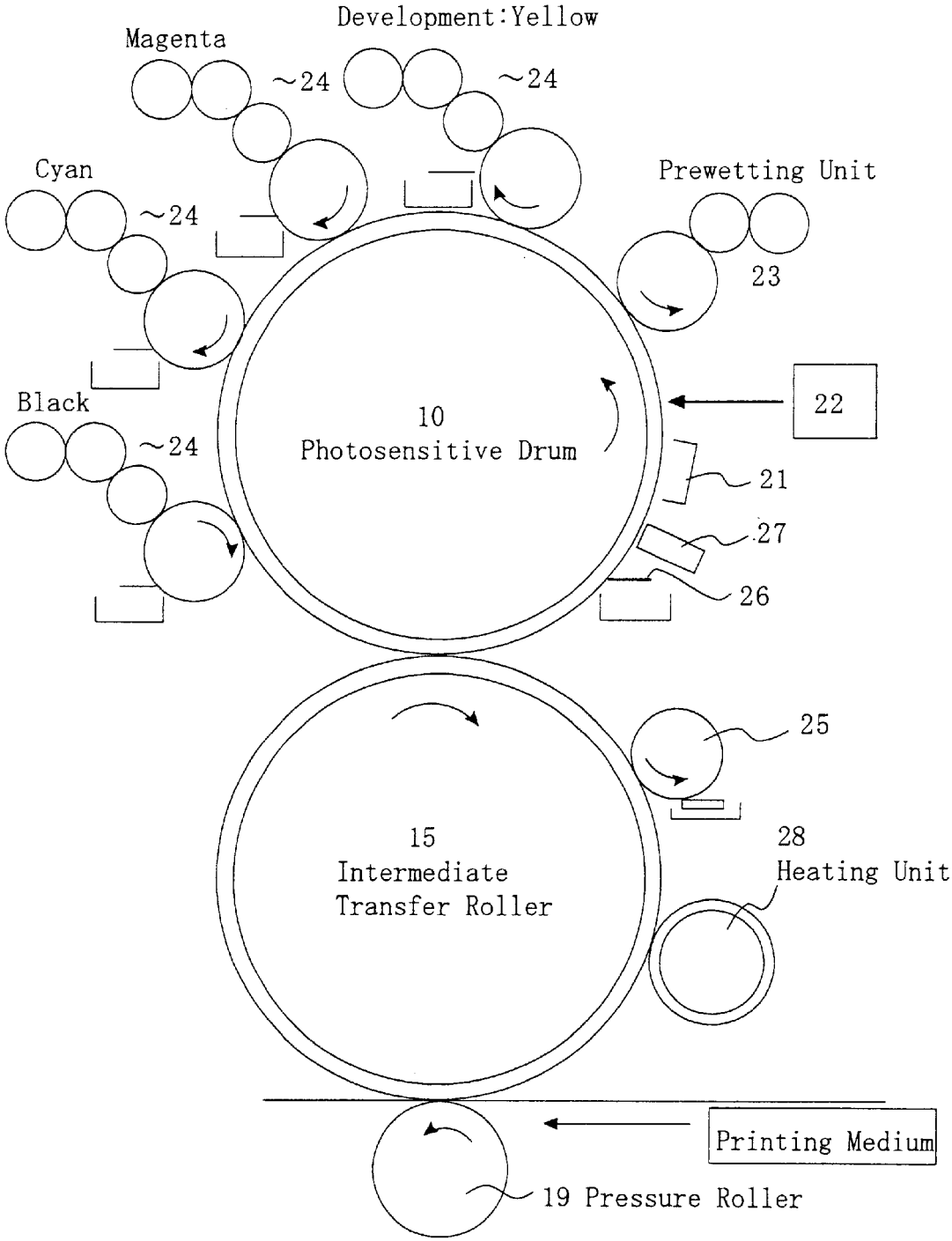
Fig. 8 Prior Art
FIG. 8 is a view showing the overall configuration of a conventional liquid-development-type electrophotographic apparatus.

FIG. 5 is a view showing a third embodiment of the toner cohesion enhancement unit, in which a heat roller is electrically conductive, and a bias voltage is applied to the heat roller. The heat roller abuts an intermediate transfer body to thereby thermally and electrically enhance the degree of toner cohesion. The roller which abuts the intermediate transfer body for enhancing the degree of toner cohesion can be equipped with a blade for removing adhering carrier liquid therefrom.

Through employment of means for enhancing the degree of toner cohesion of a toner image transferred onto an intermediate transfer body, the present invention can prevent reverse transfer of a previously transferred toner image from the intermediate transfer roller to a photosensitive body to thereby prevent image deterioration.

INDUSTRIAL APPLICABILITY

As described above, the present invention can provide a liquid-development full-color electrophotographic apparatus which optimally controls transfer of toner images in a plurality of colors from a photosensitive drum(s) to an intermediate transfer roller.

What is claimed is:

1. A liquid-development full-color electrophotographic apparatus comprising a development section using a liquid toner as a liquid developer, the development section being in contact with an image bearer body, on which an electrostatic latent image is formed, so as to supply the liquid developer onto the image bearer body, and causing toner particles contained in the liquid developer to adhere to the image bearer body according to an electric field established between the development section and the image bearer body to thereby form a toner image; an intermediate transfer roller to which the toner image is transferred from the image bearer body according to an electric field established between the same and the image bearer body; and a transfer-and-fixation section for melting the toner image transferred onto an intermediate transfer body through application of heat at a contact portion between said intermediate transfer body and a printing medium to thereby melt-transfer the toner image onto the printing medium, wherein a plurality of image bearer bodies are provided in such a manner as to correspond to liquid toners in a plurality of colors, and, while said intermediate transfer roller rotates one rotation, toner images formed on said image bearer bodies corresponding to the respective colors are sequentially transferred and superposed on said intermediate transfer roller; and wherein an electric field for transferring a toner image from each of said image bearer bodies to said intermediate transfer roller is established through application, to said corresponding image bearer bodies, of a voltage controlled according to electric characteristics peculiar to a color toner on said image bearer bodies while said intermediate transfer roller is grounded.

2. A liquid-development full-color electrophotographic apparatus as described in claim 1, wherein a charging potential for electrostatically charging each of the plurality of image bearer bodies is varied according to the voltage applied to said corresponding image bearer body.

3. A liquid-development full-color electrophotographic apparatus as described in claim 1, wherein, in order to vary a development bias potential, which is applied to a developing roller, and a charging potential according to the voltage applied to each of the plurality of image bearer bodies, the development bias potential and the charging potential are applied with respect to an electric potential of an image bearer body.

4. A liquid-development full-color electrophotographic apparatus, comprising:

a development section using liquid toners in a plurality of colors as liquid developers, the development section being in contact with an image bearer body, on which an electrostatic latent image is formed, so as to supply the liquid developer onto the image bearer body, and causing toner particles contained in the liquid developer to adhere to the image bearer body according to an electric field established between the development section and the image bearer body to thereby form a toner image in a corresponding color;

an intermediate transfer body to which the toner image for each of the plurality of colors is transferred from the image bearer body, the transferred toner images being superposed on one another;

means for enhancing a degree of toner cohesion of the toner image transferred onto said intermediate transfer body, said means being located upstream of the image bearer body in order to suppress reverse transfer of a previously transferred toner image to the image bearer body; and a transfer-and-fixation section for melting the toner image formed, through transfer and superposition, on said intermediate transfer body through application of heat at a contact portion between said intermediate transfer body and a printing medium to thereby melt-transfer the toner image onto the printing medium.

5. A liquid-development full-color electrophotographic apparatus as described in claim 4, wherein said means for enhancing the degree of toner cohesion comprises a roller which abuts said intermediate transfer body and to which an electric field is applied, to thereby electrically enhance the degree of toner cohesion.

6. A liquid-development full-color electrophotographic apparatus as described in claim 4, wherein said means for enhancing the degree of toner cohesion comprises heating means for melting toner on said intermediate transfer body through application of heat to thereby integrate the toner on said intermediate transfer body for enhancing the degree of toner cohesion.

7. A liquid-development full-color electrophotographic apparatus as described in claim 6, wherein said heating means comprises a heat roller in contact with said intermediate transfer body.

8. A liquid-development full-color electrophotographic apparatus as described in claim 4, wherein said means for enhancing the degree of toner cohesion comprises an electrically conductive heat roller which abuts said intermediate transfer body and to which an electric field is applied, to thereby thermally and electrically enhance the degree of toner cohesion.

9. A liquid-development full-color electrophotographic apparatus as described in claim 5, further comprising means for removing adhering carrier liquid from said roller.

10. A liquid-development color electrophotographic apparatus comprising:

a development section in contact with an image bearer body on which an electrostatic latent image is formed, to supply a liquid toner developer to cause toner particles to adhere to the image bearer body according to an electric field between the development section and the image bearer body to form a toner image; and an intermediate transfer roller to which the toner image is transferred from the image bearer body according to an electric field between the same and the image bearer body, wherein, while said intermediate transfer roller rotates one rotation, toner images formed on image bearer bodies and corresponding to toner colors are sequentially transferred and superposed on said intermediate transfer roller; and wherein an electric field for transferring the toner images is applied to image bearer bodies via a voltage controlled according to color toner electric characteristics while said intermediate transfer roller is grounded.

* * * * *

UNITED STATES PATENT AND TRADEMARK OFFICE

CERTIFICATE OF CORRECTION

PATENT NO. : 6,625,415 B2
DATED : September 23, 2003
INVENTOR(S) : Yutaka Nakashima et al.

It is certified that error appears in the above-identified patent and that said Letters Patent is hereby corrected as shown below:

Title page,
Item [73], Assignee, change “Pfu” to -- PFU --.

Signed and Sealed this

Ninth Day of March, 2004

JON W. DUDAS
*Acting Director of the United States Patent and Trademark Office*